US006487752B1

(12) United States Patent
Mathews

(10) Patent No.: US 6,487,752 B1
(45) Date of Patent: Dec. 3, 2002

(54) SLIDING DOOR STOP

(76) Inventor: David S. Mathews, 32301 O'Bayley Dr., Fort Bragg, CA (US) 95437

( * ) Notice: Subject to any disclaimer, the term of this patent is extended or adjusted under 35 U.S.C. 154(b) by 119 days.

(21) Appl. No.: 09/809,697

(22) Filed: Mar. 14, 2001

Related U.S. Application Data

(60) Provisional application No. 60/190,864, filed on Mar. 21, 2000.

(51) Int. Cl.[7] ..... E05F 5/06

(52) U.S. Cl. ..... 16/86 B; 16/86 A; 16/DIG. 20; 4/610; 312/334.44

(58) Field of Search ..... 16/86 B, 86 A, 16/86 R, 82, DIG. 20, 87 R; 292/DIG. 15, DIG. 22, DIG. 46, 288; 52/207; 49/130; 4/607, 610; 312/334.44, 334.46, 295

(56) References Cited

U.S. PATENT DOCUMENTS 4,165,553 A * 8/1979 Salerno ..... 16/86 A
4,611,436 A 9/1986 Williams
4,785,485 A 11/1988 Etesam
5,233,724 A * 8/1993 Lei tert et al. ..... 16/86 A
5,718,083 A 2/1998 Dowdell, II
5,749,123 A * 5/1998 Warren et al. ..... 16/86 R

* cited by examiner

*Primary Examiner*—Anthony Knight
*Assistant Examiner*—Doug Hutton
(74) *Attorney, Agent, or Firm*—Jack Lo

(57) ABSTRACT

The present sliding door stop is positioned within the header of a sliding door frame. It is comprised of first and second arms connected by a connecting member. First and second bumper surfaces on the inner and outer edges of the first arm are respectively positioned over first and second tracks in the header. A third bumper surface on the inner edge of the second arm is also positioned over the first track. The arms are positioned around the outer roller assembly of a first sliding door which is hung on the first track, so that the stop is slaved to the movement of the door. The maximum possible overlap between the doors is limited by the first arm when the roller assembly of the first door is engaged against the first bumper surface, and the roller assembly of a second door is engaged against the second bumper surface.

5 Claims, 6 Drawing Sheets

SLIDING DOOR STOP

CROSS REFERENCE TO RELATED APPLICATIONS

I claim the benefit of a provisional patent application with Ser. No. 60/190,864 which was filed on Mar. 21, 2000.

BACKGROUND OF THE INVENTION

1. Field of the Invention

This invention relates generally to sliding doors.

2. Prior Art

Sliding doors are commonly used for shower enclosures, closets, etc. As shown in FIG. 1, a typical sliding door installation is comprised of a frame 10, and two sliding glass doors 11 and 12 movably positioned in frame 10. Roller assemblies 13–16 are attached to the top edges of doors 11 and 12, and ride on rails (not shown) in a header 17 of frame 10. When either door is opened, it overlaps the other door. Because of the narrow space between the doors, a handle 18 attached to inner door 12 must be thin enough to pass through behind outer door 11, as shown in FIG. 2. Such a handle is a mere finger pull that is no more than about 0.5 inch thick, and is difficult to grab. If a thicker, more easily grabbed handle is attached to inner door 12, it would slam against the inner edge of outer door 11 when the doors are slid to an overlapping position. Repeated slamming would cause the handle or even the glass doors to break.

OBJECTIVES OF THE INVENTION

Accordingly, the objective of the present sliding door stop is to prevent a pair of sliding doors from fully overlapping, so as to enable larger, easier-to-grasp handles to be attached to the doors without damaging the handles or the doors. Further objectives of the present invention will become apparent from a consideration of the drawings and ensuing description.

BRIEF SUMMARY OF THE INVENTION

The present sliding door stop is positioned within the header of a sliding door frame. It is comprised of first-and second arms connected by a connecting member. First and second bumper surfaces on the inner and outer edges of the first arm are respectively positioned over first and second tracks in the header. A third bumper surface on the inner edge of the second arm is also positioned over the first track. The arms are positioned around the outer roller assembly of a first sliding door which is hung on the first track, so that the stop is slaved to the movement of the door. The maximum possible overlap between the doors is limited by the first arm when the roller assembly of the first door is engaged against the first bumper surface, and the roller assembly of a second door is engaged against the second bumper surface.

DRAWING REFERENCE NUMERALS

| | |
|---|---|
| 10. Door Frame | 11. Sliding Door |
| 12. Sliding Door | 13. Roller Assembly |
| 14. Roller Assembly | 15. Roller Assembly |
| 16. Roller Assembly | 17. Header |
| 20. Door Stop | 21. First Arm |
| 22. Second Arm | 23. Connecting Member |
| 24. First Bumper Surface | 25. Second Bumper Surface |
| 26. Third Bumper Surface | 27. Resilient Pads |
| 28. First Track | 29. Second Track |
| 30. Handles | 31. Door Stop |
| 32. First Arm | 33. First Bumper Surface |
| 34. Second Bumper Surface | 35. Third Bumper Surface |
| 36. Second Arm | 37. Door Stop |
| 38. First Arm | 39. First Bumper Surface |
| 40. Second Bumper Surface | 41. Gap |

DETAILED DESCRIPTION OF THE INVENTION

FIGS. 3–5

Figure 1:
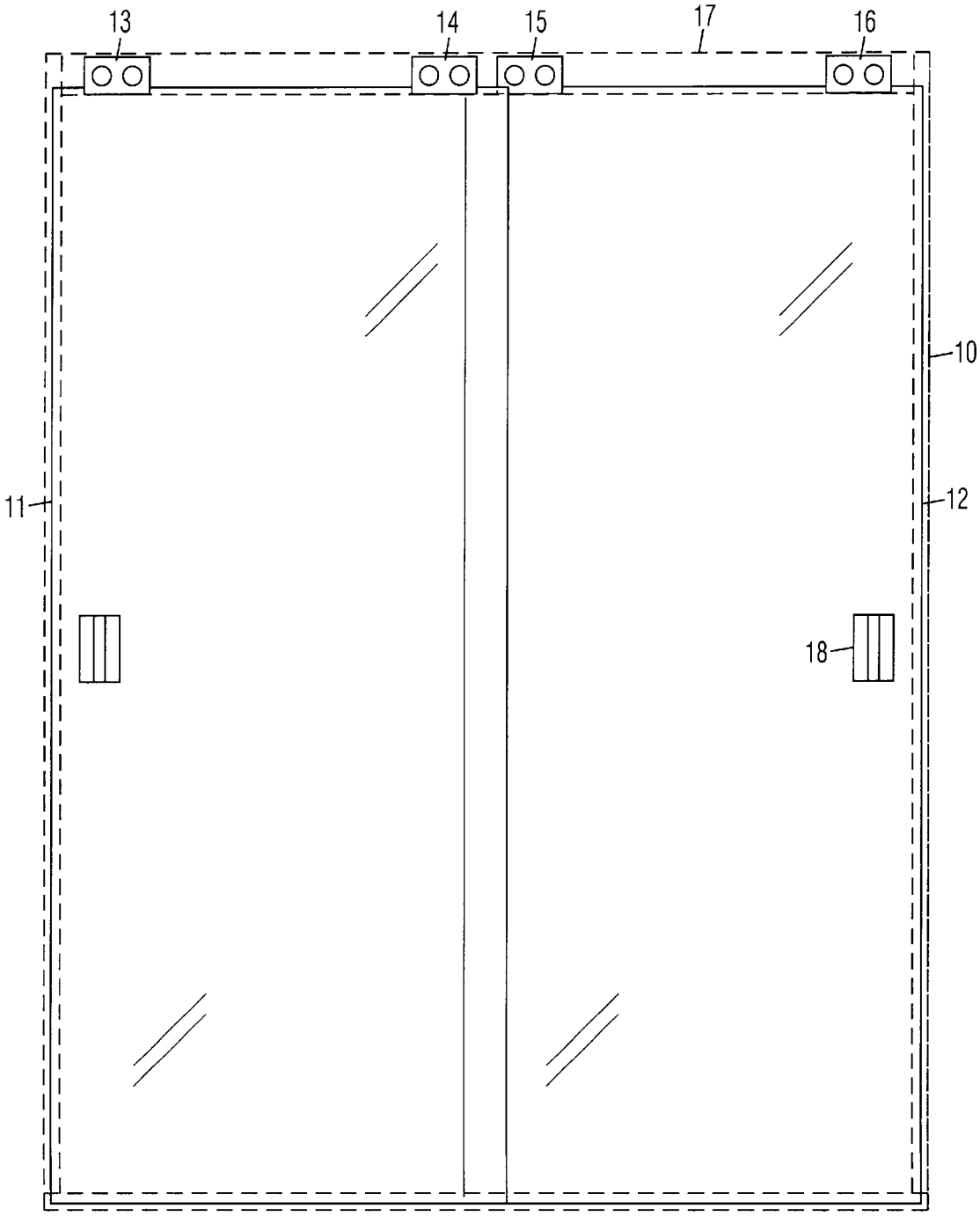
Fig. 1 Prior Art
FIG. 1 is a front view of prior art sliding doors fully closed.
Figure 2:
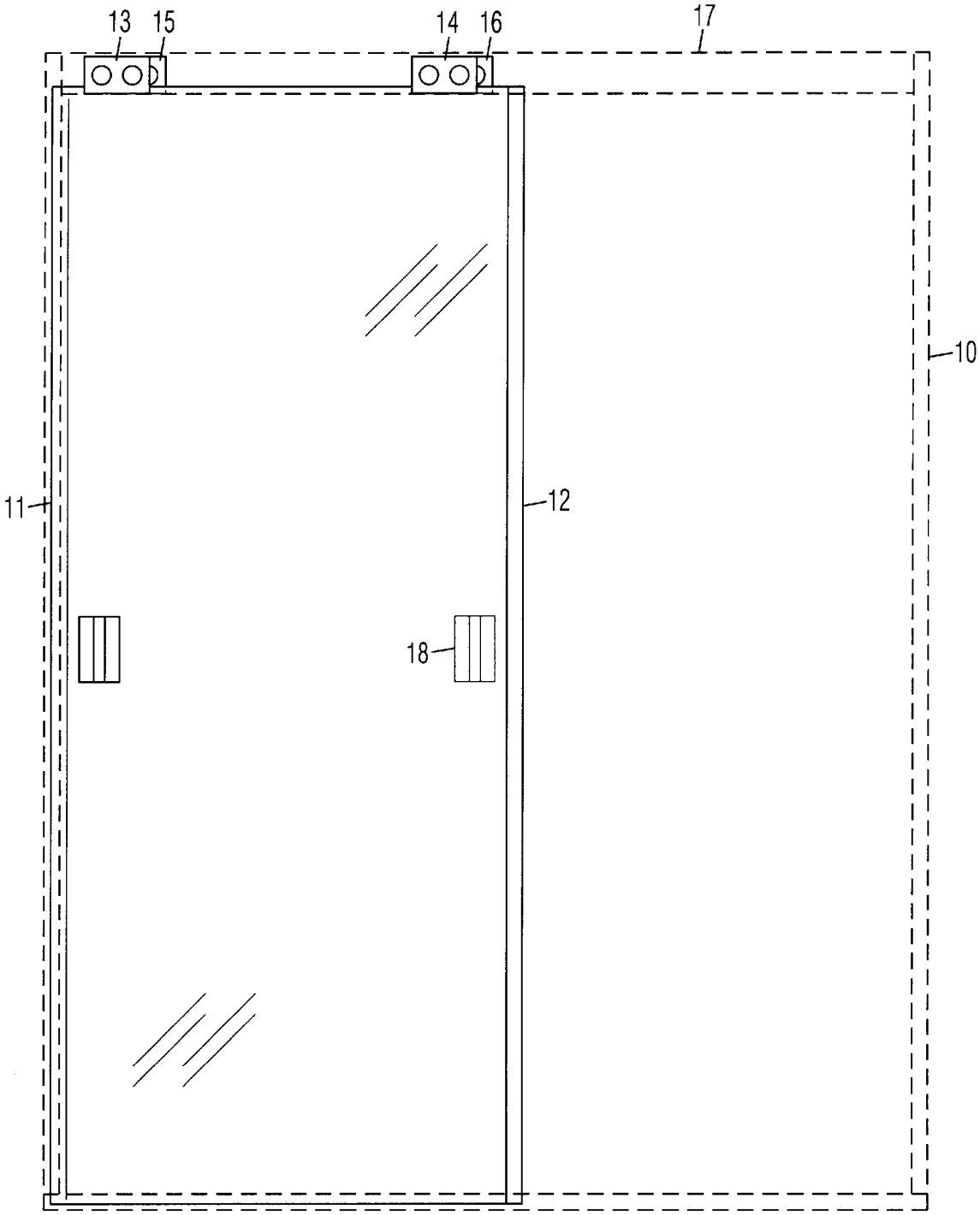
Fig. 2 Prior Art
FIG. 2 is a front view of the prior art sliding doors of FIG. 1 opened to an almost fully overlapping position.
Figure 3:
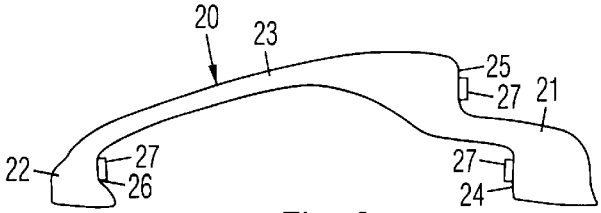
FIG. 3 is a top view of the present sliding door stop.

The present sliding door stop 20 is shown in a top view in FIG. 3. It is comprised of a zigzag-shaped first arm 21 and a second arm 22 connected by a connecting member 23 which is preferably arched for shock absorption. Door stop 20 is preferably made of a slightly flexible plastic. A first bumper surface 24 and a second bumper surface 25 are respectively arranged on the inner and outer edges of first arm 21. A third bumper surface 26 is arranged on the inner edge of second arm 22. Optional resilient pads 27 are preferably attached to the bumper surfaces. In this embodiment, first arm 21 is shaped to offset second bumper surface 25 from first bumper surface 24 toward third bumper surface 26.

Figure 4:
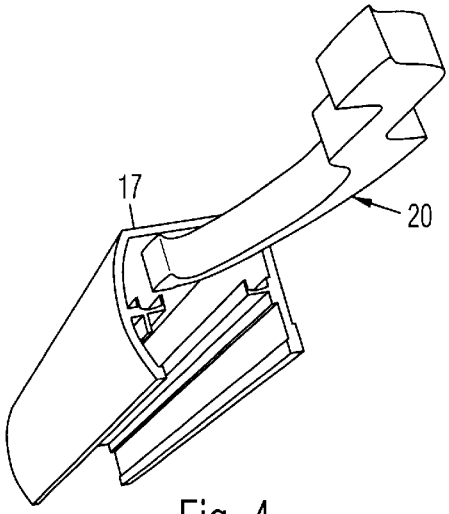
FIG. 4 is an end perspective view of the door stop being inserted into a header of a sliding door frame.
Figure 5:
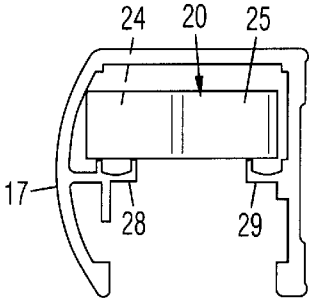
FIG. 5 is an end view of the door stop inserted into the header.

In FIG. 4, door stop 20 is shown being inserted into header 17 of the door frame during the construction of the door frame. In FIG. 5, door stop 20 is shown supported horizontally by first and second tracks 28 and 29 in header 17, and is just wide enough to fit closely but moveably within header 17. First bumper surface 24 is positioned over first track 28, and second bumper surface is positioned over second track 29. Door stop may be made in different sizes to fit different headers and doors. The orientation of door stop 20 within header 17 may be changed, depending on which way the doors overlap.

FIGS. 6–9

Figure 6:
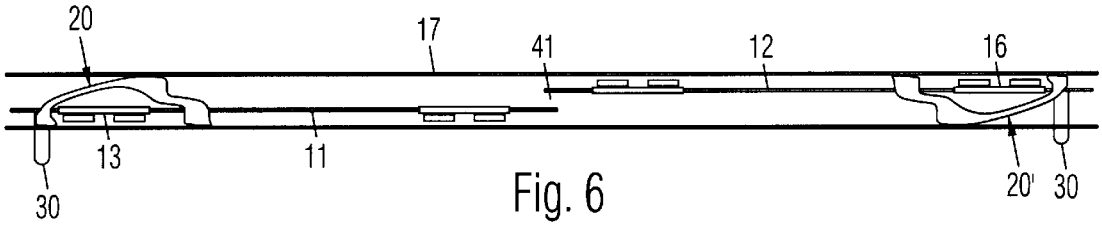
FIG. 6 is a top sectional view of the header when the sliding doors are closed.

Sliding doors 11 and 12 are shown fully closed in a top sectional view of header 17 in FIG. 6. A pair of door stops 20 and 20' are respectively positioned around outer roller assemblies 13 and 16 on doors 11 and 12, such that the arms of each door stop are positioned adjacent opposite ends of the corresponding roller assembly. The door stops are thus slaved to slide within the header with their respective doors. The doors are still free to move to their fully closed position.

Large, easy-to-grasp handles 30 are attached to the doors adjacent their outer edges. Handles 30 are thicker than a gap 41 between the doors. The relative positioning of the doors is only exemplary; they may be arranged overlap in the reverse order, that is, the left door may be higher and the right door may be lower in the figure. If the order is reversed, the orientation of the door stops would be mirrored vertically.

Figure 7:
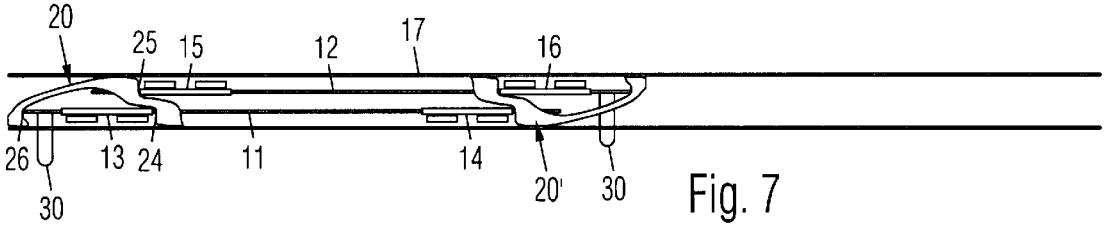
FIG. 7 is a top sectional view of the header when the sliding doors are at their maximum possible overlapping position.
Figure 8:
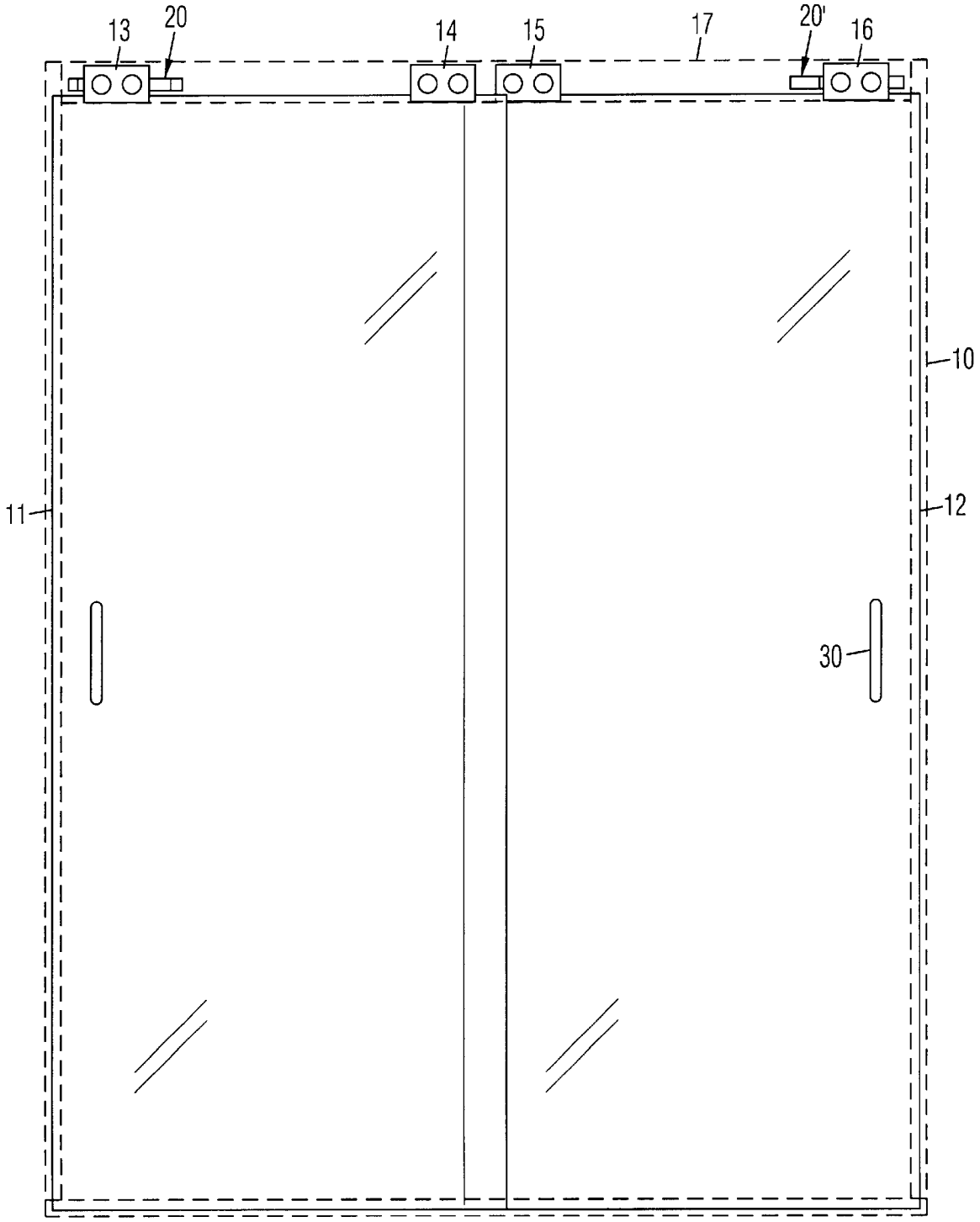
FIG. 8 is a front view of the door stops when the sliding doors are closed.
Figure 9:
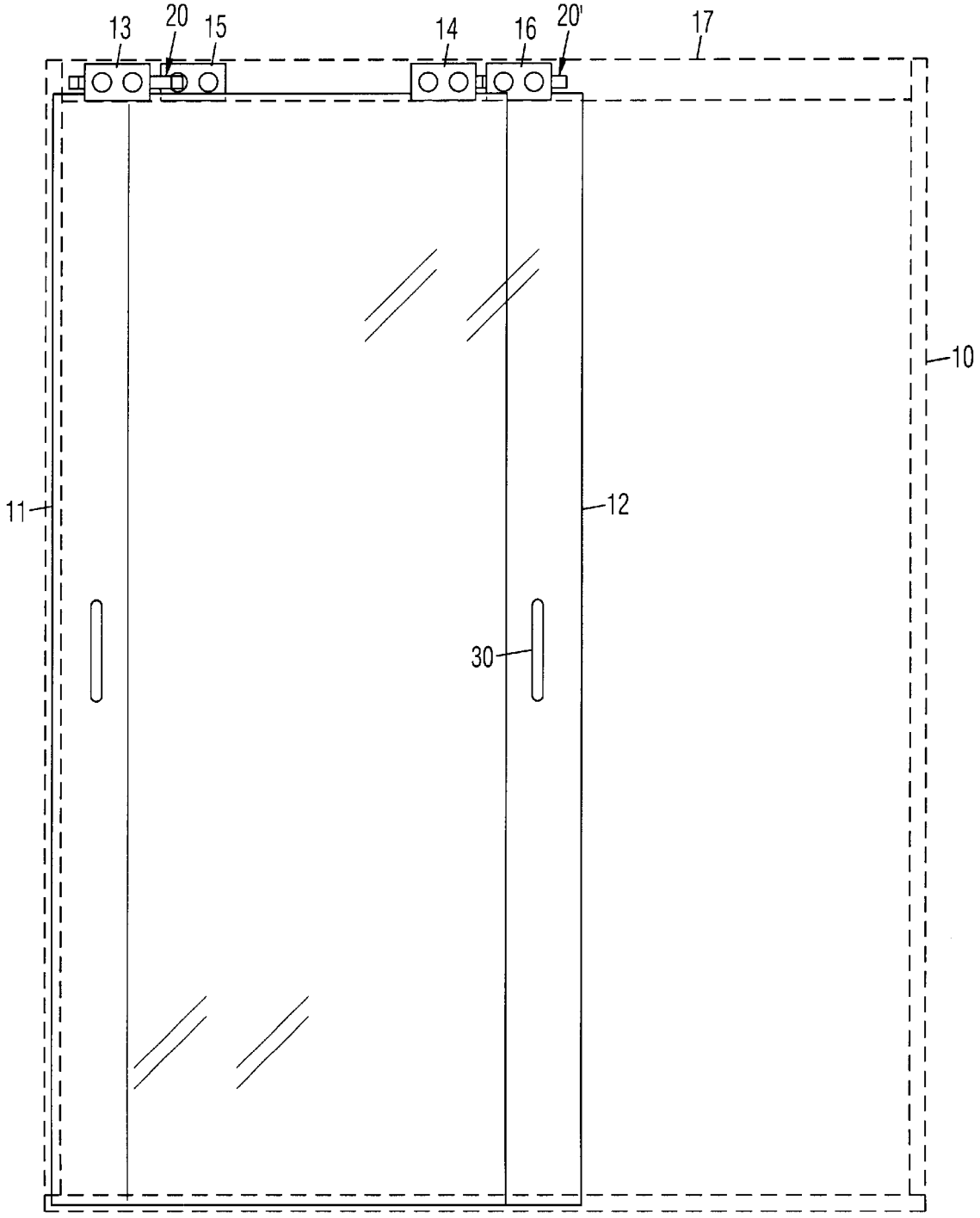
FIG. 9 is a front view of the sliding doors at their maximum possible overlapping position.

In FIG. 7, doors 11 and 12 are in their greatest possible overlapping position as limited by door stop 20. The inner edge of roller assembly 13 is engaged against first bumper surface 24, and the outer edge of inner roller assembly 15 of door 12 is engaged against second bumper surface 25. The horizontal distance between the first and second bumper surfaces determine the maximum possible overlap of the doors. The remaining non-overlapping portions of the doors are arranged to be great enough to make the doors stop short of hitting the handles. The resilient pads (too small to be shown) cushion the impact of the doors on the door stop. When the doors bump into door stop 20, the gap between roller assemblies 13 and 15 of doors 11 and 12 is filled by the intermediate portion of first arm 21, so that the roller assemblies are prevented from jumping off their tracks. Although only one door stop is required to stop the doors, the second door stop is provided to help cushion the impact and to prevent the other ends of the doors from jumping off their tracks. FIGS. 8 and 9 are respective front views of the doors at their fully closed and fully opened positions. FIG. 9 shows that the doors are prevented by the door stops from hitting handles 30.

FIGS. 10–11

Figure 10:
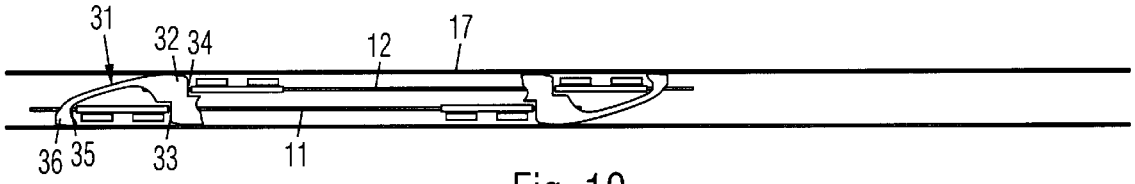
FIG. 10 is an alternative embodiment of the door stop.
Figure 11:
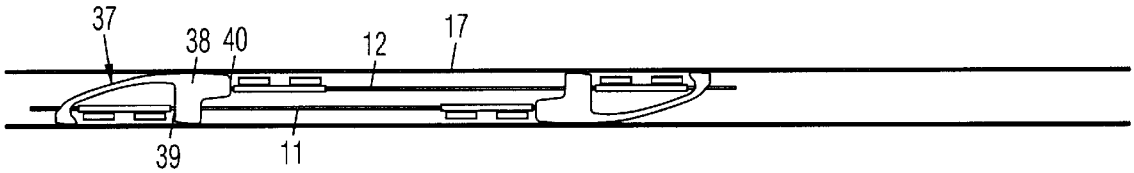
FIG. 11 is another alternative embodiment of the door stop.

The maximum possible overlap between doors is determined by the horizontal distance between the first and second bumper surfaces on the first arm. Depending on the position of the handles on the doors and the width of the roller assemblies, the proper overlap can be set by using a door stop with a suitable offset between the first and second bumper surfaces. For example, the further inward from the outer edges of the doors the handles are attached, the smaller the maximum possible overlap should be. FIG. 10 shows an alternative door stop 31 with a generally straight first arm 32 which has a first bumper surface 33 offset relative to a second bumper surface 34, such that first bumper surface 33 is between second bumper surface 34 and a third bumper surface 35 on a second arm 36. The maximum possible overlap of the doors is reduced, that is, the minimum protruding portions of the doors are increased. FIG. 11 shows another alternative door stop 37 with a generally L-shaped first arm 38 which has a first bumper surface 39 offset relative to a second bumper surface 40 even farther than the one shown in FIG. 10. The maximum possible overlap of the doors is further reduced, that is, the minimum protruding portions of the doors are further increased. The offset of the first bumper surface relative to the second bumper surface is determined by subtracting the width of the roller assembly from the width of the desired non-overlapping portion of the door.

Summary and Scope

Although the above description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A sliding door stop, comprising:

a first arm adapted to generally span an internal width of a sliding door header;

a second arm spaced from said first arm;

a connecting member connected between said first arm and said second arm;

a first bumper surface on an inner edge of said first arm adapted to be positioned over a first track in said header;

a second bumper surface on an outer edge of said first arm adapted to be positioned over a second track in said header; and a third bumper surface on an inner edge of said second arm adapted to be positioned over said first track in said header; wherein said door stop is adapted to be positioned around an outer roller assembly on a first sliding door hung on said firs track, so that said first arm and said second arm are adapted to be positioned adjacent respective opposite ends of said outer roller assembly, and said door stop is adapted to be slaved to slide with said first sliding door within said header; and said door stop is adapted to limit the maximum possible overlap of said first sliding door with a second sliding bar when said first bumper surface is engaged against an inner edge of said outer roller assembly of said first sliding door, and said second bumper surface is engaged against an outer edge of an inner roller assembly of said second sliding door hung on said second track, such that non-overlapping portions of said doors are provided to avoid damaging protruding handles on said first sliding door and said second sliding door.

2. The sliding door stop of claim 1, wherein said first arm is zigzag-shaped, and an intermediate portion of said first arm is adapted to be generally parallel to and positioned between outer roller assembly of said first sliding door and said inner roller assembly of said second sliding door when said first sliding door and said sliding door are moved to the maximum possible overlapping position, said intermediate portion of said first arm is adapted to prevent said outer roller assembly and said inner roller assembly from jumping off said first track and said second track.

3. The sliding door stop of claim 1, wherein said connecting member is arched for shock absorption.

4. The sliding door stop of claim 1, wherein said door stop is made of a slightly flexible plastic for shock absorption.

5. The sliding door stop of claim 1, further including resilient pads respectively attached to said first bumper surface, said second bumper surface, and said third bumper surface for improving shock absorption.

* * * * *